United States Patent [19]

Masumoto et al.

[11] 4,396,441

[45] Aug. 2, 1983

[54] PERMANENT MAGNET HAVING ULTRA-HIGH COERCIVE FORCE AND LARGE MAXIMUM ENERGY PRODUCT AND METHOD OF PRODUCING THE SAME

[75] Inventors: Hakaru Masumoto; Kiyoshi Watanabe, both of Sendai, Japan

[73] Assignee: The Foundation: The Research Institute of Electric and Magnetic Alloys, Sendai, Japan

[21] Appl. No.: 318,402

[22] Filed: Nov. 5, 1981

[30] Foreign Application Priority Data

Apr. 27, 1981 [JP] Japan ..... 56-62546

[51] Int. Cl.[3] ..... H01F 1/02

[52] U.S. Cl. ..... 148/101; 148/102; 148/31.55; 420/466

[58] Field of Search ..... 75/172 R; 148/31.57, 148/101, 102, 103, 120, 121, 122; 420/466

[56] References Cited

U.S. PATENT DOCUMENTS

| | | | |
|---|---|---|---|
| 3,444,012 | 5/1969 | Shimizu et al. | 148/31.57 |
| 3,689,254 | 9/1972 | Inoue et al. | 148/31.57 |
| 4,221,615 | 9/1980 | Shine | 148/120 |

OTHER PUBLICATIONS

Hansen, "Constitution of Binary Alloys" 1958, pp. 698–700.

*Primary Examiner*—John P. Sheehan

*Attorney, Agent, or Firm*—Parkhurst & Oliff

[57] ABSTRACT

The disclosed permanent magnet has a coercive force of 500 Oe or more, a residual magnetic flux density of 5 kG or more, and a maximum energy product of 2 MG. Oe or more. The magnet alloy consists essentially of platinum and iron, and has an initial state of homogeneous dispersion of $\gamma_1$ phase of face-centered tetragonal type in a $\gamma$ phase matrix of face-centered cubic type. To produce the magnet, the alloy is heated at 900° to 1,400° C. for 1 minute to 100 hours for homogenizing solid solution treatment, and quenched in water or in air at a rate of 30° C./minute to 2,000° C./second.

4 Claims, 5 Drawing Figures

PERMANENT MAGNET HAVING ULTRA-HIGH COERCIVE FORCE AND LARGE MAXIMUM ENERGY PRODUCT AND METHOD OF PRODUCING THE SAME

BACKGROUND OF THE INVENTION

1. Field of the Invention

This invention relates to a permanent magnet consisting essentially of platinum and iron with a small quantity (less than 0.5%) of impurities and to a method of producing the same. More particularly, the invention provides a permanent magnet having an ultra-high coercive force and a very large maximum energy product, which permanent magnet is easy to work.

2. Description of the Prior Art

As permanent magnets using order-disorder lattice transformation, magnets made of an alloy consisting of cobalt (Co) and platinum (Pt) at about a stoichiometric ratio thereof have been known. At high temperatures, the cobalt-platinum alloy has $\alpha$ phase disordered lattice of face-centered cubic type, while at low temperatures, it has $\gamma_1$ phase ordered lattice of face-centered tetragonal type. Accordingly, an ultra-high coercive force and a very large maximum energy product can be achieved in the initial state of transformation of the $\alpha$ phase disordered lattice into $\gamma_1$ phase ordered lattice, either by cooling the alloy of $\alpha$ phase from high temperature of 1,000° C. at a certain speed and annealing at 600° C. or by quenching followed by annealing. However, the aforesaid alloy has shortcomings in that it requires a large amount of platinum, because the stoichiometric composition for providing the largest values of coercive force and maximum energy product includes 77.8 weight % of platinum, and in that its ferromagnetic atoms are cobalt atoms having a smaller magnetic moment than that of iron atoms and the magnetic properties of the alloy cannot be improved beyond certain limits such as a residual magnetic flux density of 7.2 kG (kilo-Gauss) and a maximum energy product of 12 MG.Oe (Mega Gauss.Oersted).

SUMMARY OF THE INVENTION

Therefore, an object of the present invention is to obviate the aforesaid shortcomings of the prior art by providing an improved permanent magnet. The permanent magnet of the present invention uses order-disorder transformation from $\gamma$ phase disordered lattice of face-centered cubic type to $\gamma_1$ phase ordered lattice of face-centered tetragonal type.

As regards the magnetic properties of iron-platinum alloys, Watarai and Shimizu succeeded in 1965 in obtaining a maximum energy product of 7.6 MG.Oe (after correction for density) at a coercive force of 7.4 kOe, by pulverizing an alloy consisting of 50 atomic % of platinum (Pt) and the remainder of iron (Fe) to produce disordered conditions, as disclosed in the Journal of Japanese Institute of Metallurgists, Volume 29 (1965), page 822. However, what they succeeded was nothing but experimental values of permanent magnets in powdery state, and such alloy was never produced in the form of a cast body.

The inventors noted the fact that the transformation point from $\gamma$ phase disorderd lattice to $\gamma_1$ phase ordered lattice of the alloy consisting of 50 atomic % of platinum and the remainder of iron is so high, being at about 1,320° C., that even quenching by water tends to cause an excessive formation of ordered lattice and good magnets are hardly produced. On the other hand, the temperature of the transformation point can be reduced to about 800° C. by modifying the alloy composition, so that $\gamma$ phase disordered lattice can be fairly easily produced. More particularly, excessive quick progress of the formation of ordered lattice is prevented by quenching, so that the initial stage of transformation from the $\gamma$ phase disordered lattice of cubic type to $\gamma_1$ phase ordered lattice of face-centered tetragonal type, namely the stage in which fine crystals of $\gamma_1$ phase ordered lattice are homogeneously dispersed in a matrix of $\gamma$ phase disordered lattice, can be brought into and fixed at the room temperature, whereby a permanent magnet having an ultrahigh coercive force and a large maximum energy product is produced.

An object of the present invention is to provide a permanent magnet having an ultra-high coercive force and a large maximum energy product, which permanent magnet consists of 33.5 to 47.5 atomic % (63.76 to 75.96 weight %) of platinum and the remainder of iron with less than 0.5% of impurities.

A method of producing the aforesaid permanent magnet includes the following combination of heat treatments.

(A) Alloy consisting of 33.5 to 47.5 atomic % of platinum and the remainder of iron is melted by using a suitable melting furnace, and the molten alloy is thoroughly agitated to get a melt of the alloy with homogeneous composition. The melt is shaped by pouring it into a die of desired shape or by further working through drawing, forging, or rolling. The body thus shaped is heated at 900° to 1,400° C. for 1 minute to 100 hours for effecting a homogenizing solid solution treatment, and then quenched, whereby the initial stage of transformation from $\gamma$ phase disordered lattice of face-centered cubic type into $\gamma_1$ phase ordered lattice of face-centered tetragonal type, i.e., the stage in which fine crystals of $\gamma_1$ phase of ordered lattice are homogeneously dispersed in a matrix of $\gamma$ phase disordered lattice, is brought to room temperature by quenching and fixed thereto.

(B) After the quenching treatment (A), plastic working with a cross sectional reduction of not less than 90% is applied by drawing or rolling.

(C) After the plastic working (B) with a cross sectional reduction of not less than 90%, the worked body is heated at 400° to 700° C. for 1 minute to 300 hours, and then cooled. This treatment is to temper the worked body after the plastic working (B) for appending internal strain caused thereby, so as to produce excellent properties of the desired permanent magnet. The cooling in this annealing treatment can be either quick or slow cooling.

The reasons for choosing the aforesaid conditions of the heat treatment are as follows: namely, the cooling after the homogenizing solid solution treatment at 900° to 1,400° C. for producing the single $\gamma$ phase disordered lattice can be carried out in water, in air, or in a furnace, but preferably, such cooling must be effected as quickly as possible. Thereafter, the annealing can be dispensed with for alloys of certain compositions, but when necessary, the annealing is effected by heating at a temperature of 400° C. or higher (preferably 425° to 650° C.) for at least one minute but less than 300 hours (preferably 20 minutes to 200 hours) so as to remove local strains caused in the initial stage of transformation from the $\gamma$ phase solid solution of disordered lattice into the $\gamma_1$ phase ordered lattice. By this method, a permanent magnet having an ultra-high coercive force and a very large maximum energy product can be produced.

If the annealing temperature exceeds 700° C., the ordered lattice is formed excessively, resulting in a reduction of the aforesaid magnetic properties. Thus annealing at above 700° C. is not desirable. On the other hand, if the annealing temperature is below 400° C., the annealing time becomes longer than 300 hours. Such an excessively long annealing time is not only uneconomical but also non-effective in improving the magnetic properties. Accordingly, when annealing is necessary, annealing at 400° to 700° C. is preferable.

BRIEF DESCRIPTION OF THE DRAWINGS

For a better understanding of the invention, reference is made to the accompanying drawings, in which.

DESCRIPTION OF THE PREFERRED EMBODIMENTS

Figure 1:
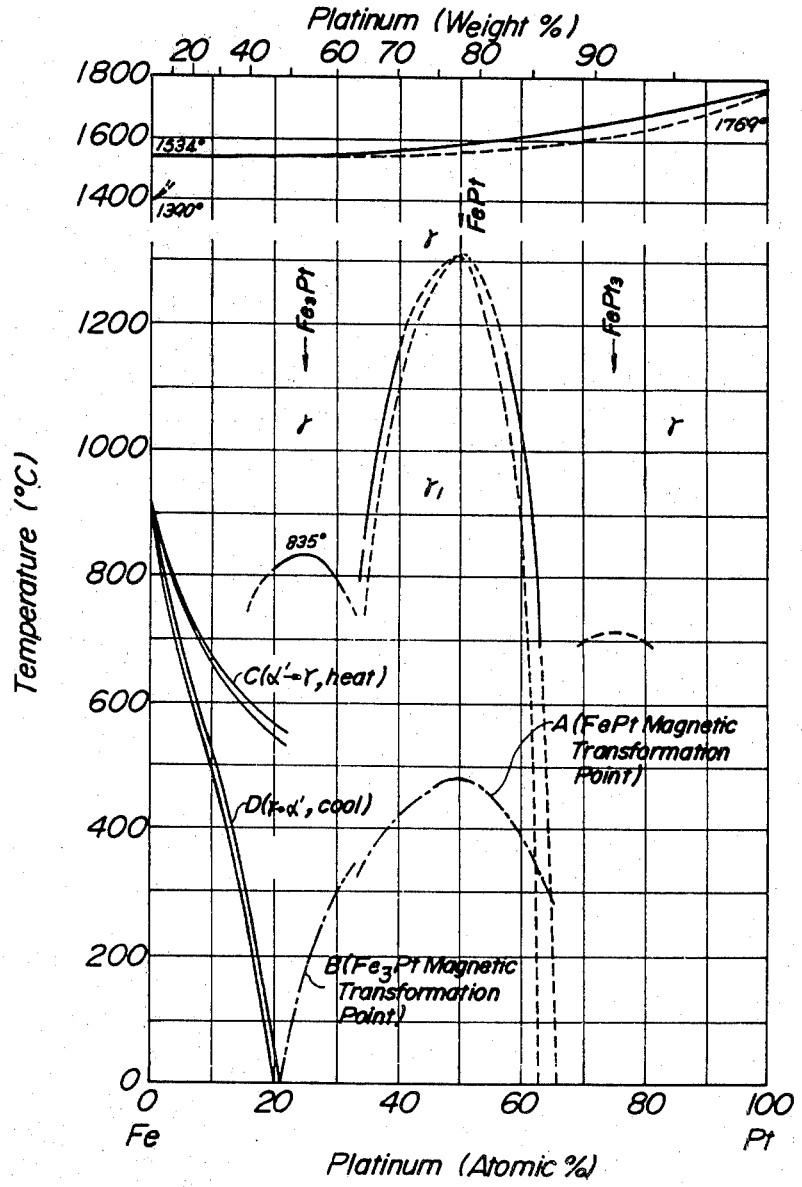
FIG. 1 is an equilibrium diagram of iron-platinum (Fe-Pt) alloy.

Referring to the equilibrium diagram of FIG. 1, when iron-platinum (Fe-Pt) alloy contains 50 atomic % of iron, the transformation point of the alloy from the $\gamma$ phase disordered lattice to $\gamma_1$ phase ordered lattice is at about 1,320° C. Due to such high temperature of the transformation point, it has been difficult to obtain good magnetic properties by using the iron-platinum alloy containing 50 atomic % of platinum.

The present invention obviates the aforesaid difficulty by providing an improved alloy.

Preferred embodiments of the invention will be described. As starting materials, electrolytic iron with a purity of 99.9% and platinum were used. To prepare a sample for experiments, the starting materials were weighed so as to form a mixture of 10 grams having a desired chemical composition, and the mixture was placed in an alumina Tammann furnace and melted by the Tammann furnace while blowing argon gas thereto. The molten mixture was thoroughly agitated so as to produce homogeneous molten alloy, which was then sucked into a quartz tube with a diameter of about 3 to 3.5 mm. The round rod thus formed was cut into a 25 mm long sample piece. Other samples of different chemical compositions were similarly prepared, as shown in Table 1. The samples were heated at 900° to 1,400° C. for about 1 hour and water quenched, and the following tests were carried out.

Figure 2:
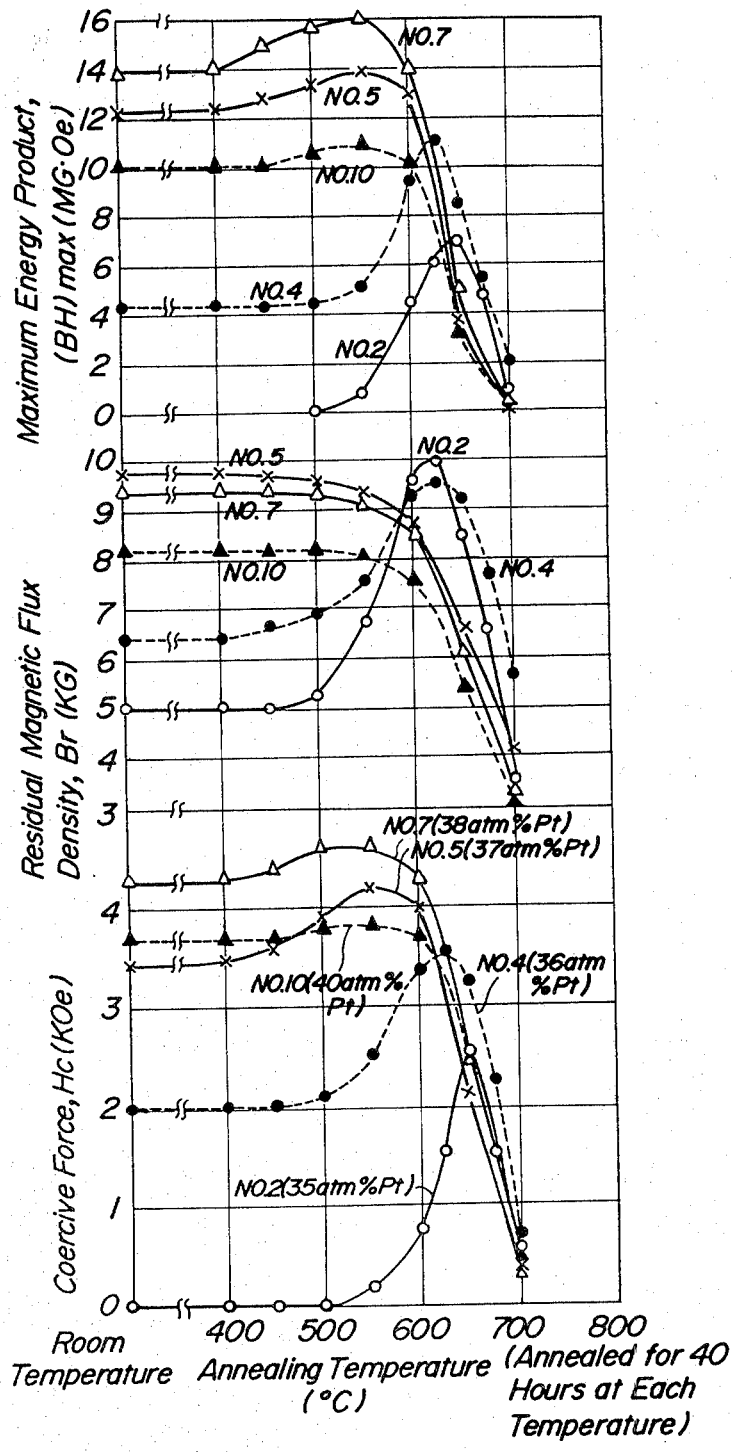
FIG. 2 is a graph showing the relationship between the annealing temperature and the magnetic properties of five samples of the iron-platinum alloy containing 33.5 to 47.5 atomic % of platinum according to the present invention.
Figure 3:
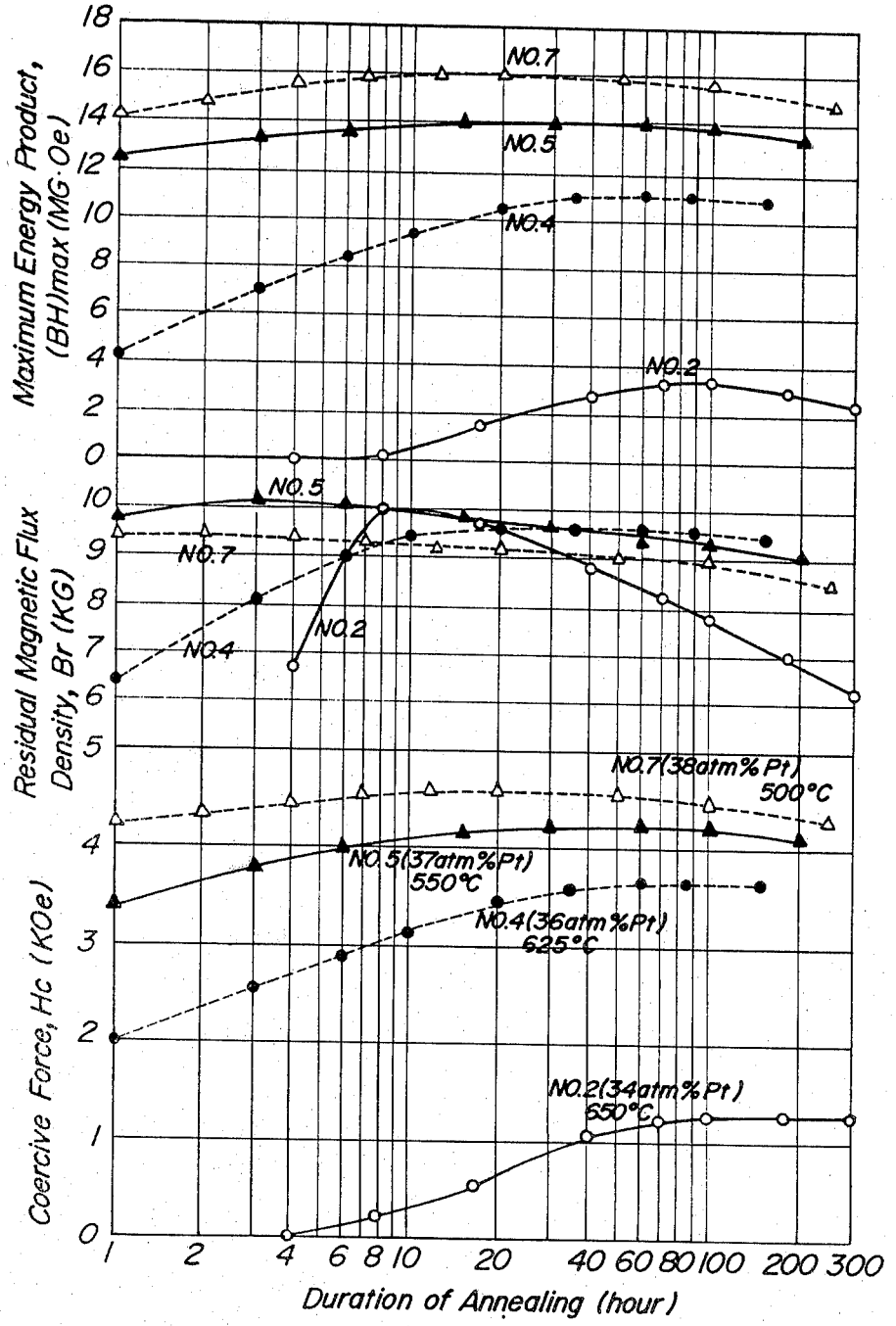
FIG. 3 is a graph showing the relationship between the duration of constant temperature annealing and the magnetic properties of four typical samples of the alloy according to the present invention.
Figure 4:
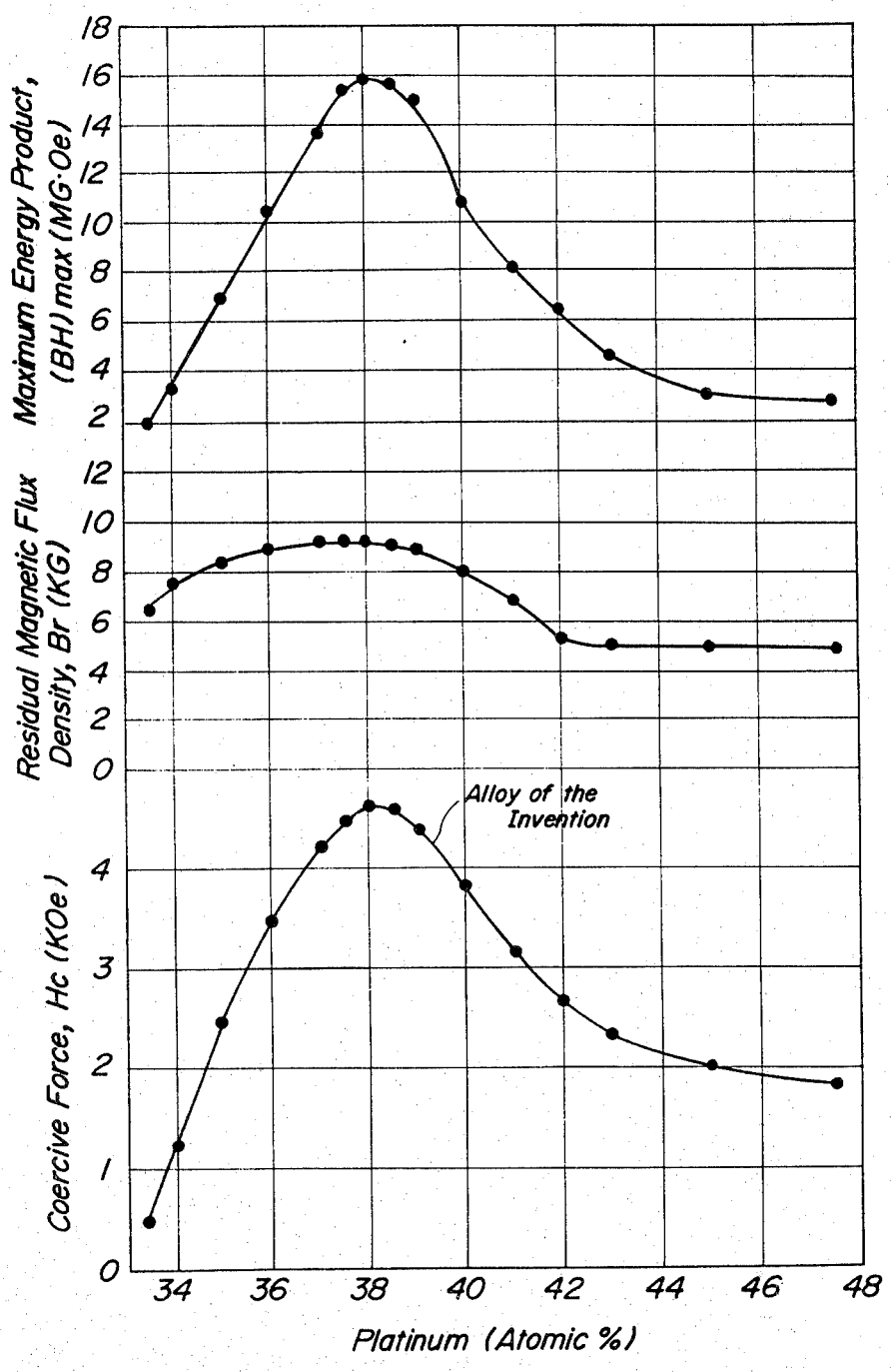
FIG. 4 is a graph showing the relationship between the chemical composition and the magnetic properties of the iron-platinum (Fe-Pt) alloy of the invention.

Five samples thus heat related, namely Samples No. 2, No. 4, No. 5, No. 7, and No. 10, were annealed by heating for 40 hours at different temperatures in a range of 400° to 700° C. The magnetic properties of the samples thus annealed are shown in FIG. 2. FIG. 3 shows the relationship betweeen the duration of the constant-temperature annealing and the magnetic properties of the alloy samples of the invention, and FIG. 4 shows the relationship between the chemical composition and the magnetic properties of the alloy samples of the invention. As can be seen in the figures, the annealing temperature for producing a high coercive force varied with the composition of the alloy. When the iron content was high, e.g., Samples No. 2 and No. 4, annealing at 600° to 650° C. resulted in an outstanding improvement of the coercive force. With higher contents of platinum, e.g., Samples No. 5 and No. 7, the suitable annealing temperature was lower than that for the alloys of lower contents of platinum. When the content of platinum was further increased, as in the case of Sample No. 10, the annealing treatment did not cause outstanding effects, if any. If being annealed at a temperature between 675° C. and 900° C., the alloy generally had a considerably smaller coercive force.

The above test results proved the following: namely, the present invention produces ultra-high coercive forces by using either that $\gamma_1$ phase ordered lattice which is kept as strained by water quenching, or that alloy which has such a composition that completely ordered lattice is not formed after the order-disorder transformation and high coercive force is produced by annealing the alloy for a certain time at a temperature in a range of 400° to 700° C.

TABLE 1(a)

| | Composition | | | | Annealing condition | | Magnetic properties | | |
|---|---|---|---|---|---|---|---|---|---|
| Sample No. | Iron (Fe) (Atm %) | Platinum (Pt) (Atm %) | Platinum (Pt) (Wt %) | Quenching conditions (see notes below) | Temperature (°C.) | Duration (h) | Coercive force, $H_c$ (kOe) | Residual magnetic flux density, Br (kG) | Maximum energy product, $(BH)_{max}$ (MG.Oe) |
| 2 | 66 | 34 | 64.3 | a | 650 | 100 | 1.25 | 7.80 | 3.28 |
| | | | | d | 650 | 80 | 1.50 | 8.00 | 3.53 |
| 3 | 65 | 35 | 65.3 | a | 625 | 200 | 2.50 | 8.40 | 7.02 |
| | | | | d | 625 | 170 | 3.00 | 9.00 | 8.20 |
| 4 | 64 | 36 | 66.3 | a | 625 | 100 | 3.50 | 9.00 | 10.48 |
| | | | | d | 625 | 85 | 3.65 | 9.50 | 11.04 |
| 5 | 63 | 37 | 67.2 | a | 550 | 100 | 4.23 | 9.30 | 13.78 |
| | | | | a | no annealing | | 2.00 | 6.40 | 4.37 |
| 6 | 62.5 | 37.5 | 67.7 | a | 525 | 100 | 4.45 | 9.40 | 15.42 |
| 7 | 62 | 38 | 68.2 | a | 500 | 20 | 4.60 | 9.20 | 16.03 |
| | | | | a | no annealing | | 4.30 | 9.40 | 14.01 |
| | | | | b | 500 | 20 | 3.90 | 9.00 | 14.20 |
| | | | | c | no annealing | | 2.00 | 6.50 | 4.12 |

TABLE 1(b)

| Sample No. | Composition: Iron (Fe) (Atm %) | Composition: Platinum (Pt) (Atm %) | Composition: Platinum (Pt) (Wt %) | Quenching conditions (see notes below) | Annealing condition: Temperature (°C.) | Annealing condition: Duration (h) | Magnetic properties: Coercive force, $H_c$ (kOe) | Magnetic properties: Residual magnetic flux density, Br (kG) | Magnetic properties: Maximum energy product, $(BH)_{max}$ (MG.Oe) |
|---|---|---|---|---|---|---|---|---|---|
| 8 | 61.5 | 38.5 | 68.6 | a | 500 | 25 | 4.58 | 9.10 | 15.71 |
| 9 | 60.5 | 39.5 | 69.6 | a | 500 | 25 | 4.48 | 9.09 | 15.61 |
| 10 | 60 | 40 | 70.0 | a | 500 | 30 | 3.85 | 8.10 | 10.78 |
| | | | | b | 500 | 30 | 3.70 | 7.80 | 9.75 |
| | | | | c | no annealing | | 1.50 | 5.50 | 2.45 |
| 12 | 58 | 42 | 71.7 | a | no annealing | | 2.65 | 5.40 | 6.42 |
| 14 | 55 | 45 | 74.1 | a | no annealing | | 2.00 | 5.00 | 3.00 |

Notes:
a, water quenched;
b, cooled in air;
c, as casted;
d, drawn into wire after being water quenched.

Table 1 also shows magnetic properties of Samples No. 2, No. 3, and No. 4 which Samples were water quenched after heating at about 1,000° C. or higher for one hour and then annealed by drawing into wires at a rate of about 90% cross sectional reduction or more. As can be seen from Table 1, the wire drawing improved the magnetic properties of all the Samples. More particularly, the alloy of Sample No. 4 containing 36 atomic % of platinum produced a maximum coercive force of 3.65 kOe, and the alloy with that maximum coercive force had a residual magnetic flux density of 9.5 kG and a maximum energy product of 11.04 MG.Oe.

Figure 5:
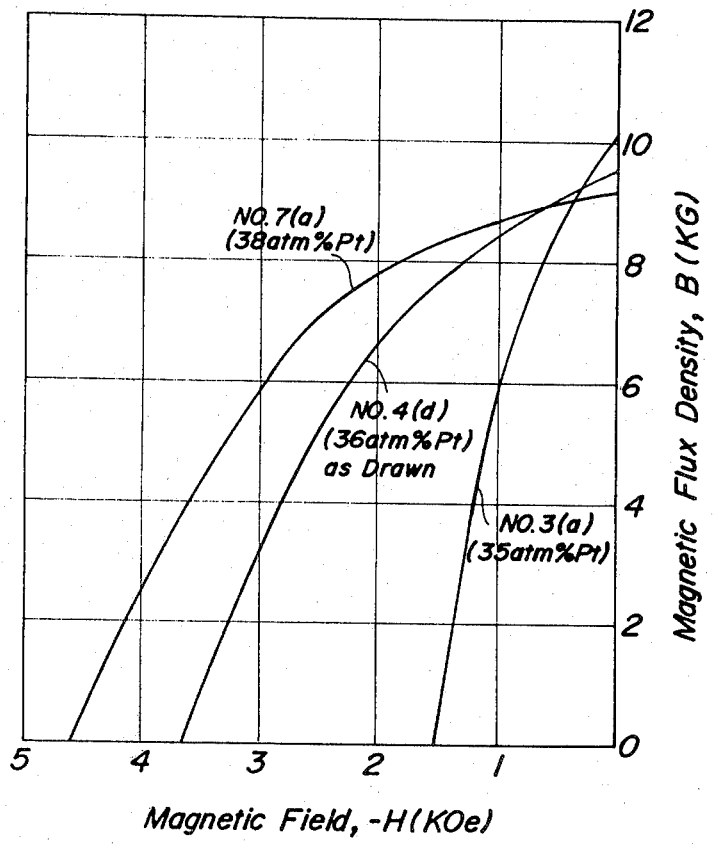
FIG. 5 shows demagnetizing curves of typical samples of the alloy of the invention, namely, Samples No. 3(a), No. 4(d), and No. 7(a) of Table 1.

FIG. 5 shows demagnetizing curves of three Samples; namely, Sample No. 3(a) (as water quenched) having a comparatively high residual magnetic flux density, Sample No. 4(d) (as drawn into wire after water quenching), and Sample No. 7(a) which showed the highest coercive force. The alloys of the Samples were easy to work and particularly suitable for producing small magnets of complicated shape.

In the present invention, the content of platinum is limited to be 33.5 to 47.5 atomic %, because this limitation not only reduces the amount of platinum as compared with that in iron-platinum alloy containing 50 atomic % of platinum at a stoichiometric ratio but also produces excellent magnetic properties such as the aforesaid highest coercive force of 4.6 kOe. Besides, alloy compositions outside the aforesaid limited range proved to produce inferior magnetic properties to those of the invention whatever conditions may be used for production. Preferable range of platinum content in the alloy composition of the present invention is 34 to 39.5 atomic %.

As described in the foregoing, the permanent magnet of the present invention is featured in the simpleness of the heat treatment for production thereof, the high workability due to the binary iron-platinum composition thereof, and the outstanding magnetic properties including the ultra-high coercive force and the very large maximum energy product.

Although the invention has been described by referring to the preferred embodiments, it should be understood that numerous changes are possible without departing from the scope of the invention as hereinafter claimed.

What is claimed is:

1. A permanent magnet, said permanent magnet having a coercive force of not less than 500 Oe, a residual magnetic flux density of not less than 5 kG, and a maximum energy product of not less than 2 MG.Oe, said permanent magnet consisting of 33.5 to 47.5 atomic % (63.76 to 75.96 weight %) of platinum and the remainder of iron with less than 0.5% of impurities, said permanent magnet having a structure of homogeneous dispersion of $\gamma_1$ phase of face-centered tetragonal type in a $\gamma$ phase matrix of face-centered cubic type.

2. A method of producing a permanent magnet having an ultra-high coercive force and a large maximum energy product, comprising steps of heating an alloy at 900° to 1,400° C. for one minute to 100 hours so as to effect homogenizing solid solution treatment, which alloy consists of 33.5 to 47.5 atomic % of platinum and the remainder of iron with a small amount of impurities, and quenching said alloy in water or in air at a rate of 30° C./minute to 2,000° C./second.

3. A method of producing a permanent magnet having an ultra-high coercive force and a large maximum energy product, comprising steps of heating an alloy at 900 to 1,400° C. for one minute to 100 hours so as to effect homogenizing solid solution treatment, which alloy consists of 33.5 to 47.5 atomic % of platinum and the remainder of iron with a small amount of impurities, quenching said alloy, reheating said quenched alloy at 400° to 700° C. for one minute to 100 hours, and cooling the reheated alloy.

4. A method of producing a permanent magnet having an ultra-high coercive force and a large maximum energy product, comprising steps of heating an alloy at 900° to 1,400° C. for one minute to 100 hours so as to effect homogenizing solid solution treatment, which alloy consists of 33.5 to 47.5 atomic % of platinum and the remainder of iron with a small amount of impurities, quenching said alloy in water or in air at a rate of 30° C./minute to 2,000° C./second, applying plastic working of not less than 90% to the thus quenched alloy by drawing into wire or rolling, reheating the worked alloy at 400° to 700° C. for one minute to 300 hours, and cooling the reheated alloy.

* * * * *